United States Patent [19]

Erickson

[11] 3,966,367

[45] June 29, 1976

[54] HYDRAULIC MOTOR OR PUMP WITH MOVABLE WEDGE

[76] Inventor: Lewis C. Erickson, 3328 E. Superior St., Duluth, Minn. 55804

[22] Filed: Jan. 16, 1975

[21] Appl. No.: 541,402

[52] U.S. Cl. ..... 418/58; 418/126; 418/129; 418/132; 418/165; 418/186

[51] Int. Cl.[2] ..... F01C 19/04; F01C 19/08; F01C 1/10; F04C 1/06

[58] Field of Search ..... 418/58, 61 R, 126–129, 418/132, 165, 186, 187, 189; 180/66 F; 192/61

[56] References Cited

UNITED STATES PATENTS

| | | | |
|---|---|---|---|
| 2,311,237 | 2/1943 | Loveday | 418/165 |
| 2,540,235 | 2/1951 | Berkley | 418/189 |
| 3,151,526 | 10/1964 | Van Hoene | 418/165 |
| 3,525,581 | 8/1970 | Eckerle | 418/126 |
| 3,650,643 | 3/1972 | Grennan et al. | 418/27 |
| 3,849,039 | 11/1974 | Leidig | 418/165 |
| 3,873,241 | 3/1975 | Motomura | 418/126 |

FOREIGN PATENTS OR APPLICATIONS

| | | | |
|---|---|---|---|
| 871,692 | 3/1953 | Germany | 418/165 |
| 1,120,631 | 7/1968 | United Kingdom | 418/187 |

*Primary Examiner*—John J. Vrablik

*Attorney, Agent, or Firm*—Schroeder, Siegfried, Ryan & Vidas

[57] ABSTRACT

In a fluid motor or pump, a combinaton is disclosed having an internal ring gear operably secured within a housing meshing with a pinion gear and having a wedge with a shape conforming to the outer peripheries of the ring and pinion gears to provide a sealing effect and pressure or suction chamber where the wedge has a piston end and porting in the tip thereof to create a hydrostatic pressure in an operable direction to overcome pressure from the chamber and means for supporting the pinion gearing and carrying the wedge in slidable relatonship where the mechanism receives fluid under pressure from a source to the pressure chamber and includes means for returning fluid to the source.

21 Claims, 10 Drawing Figures

Fig. 8
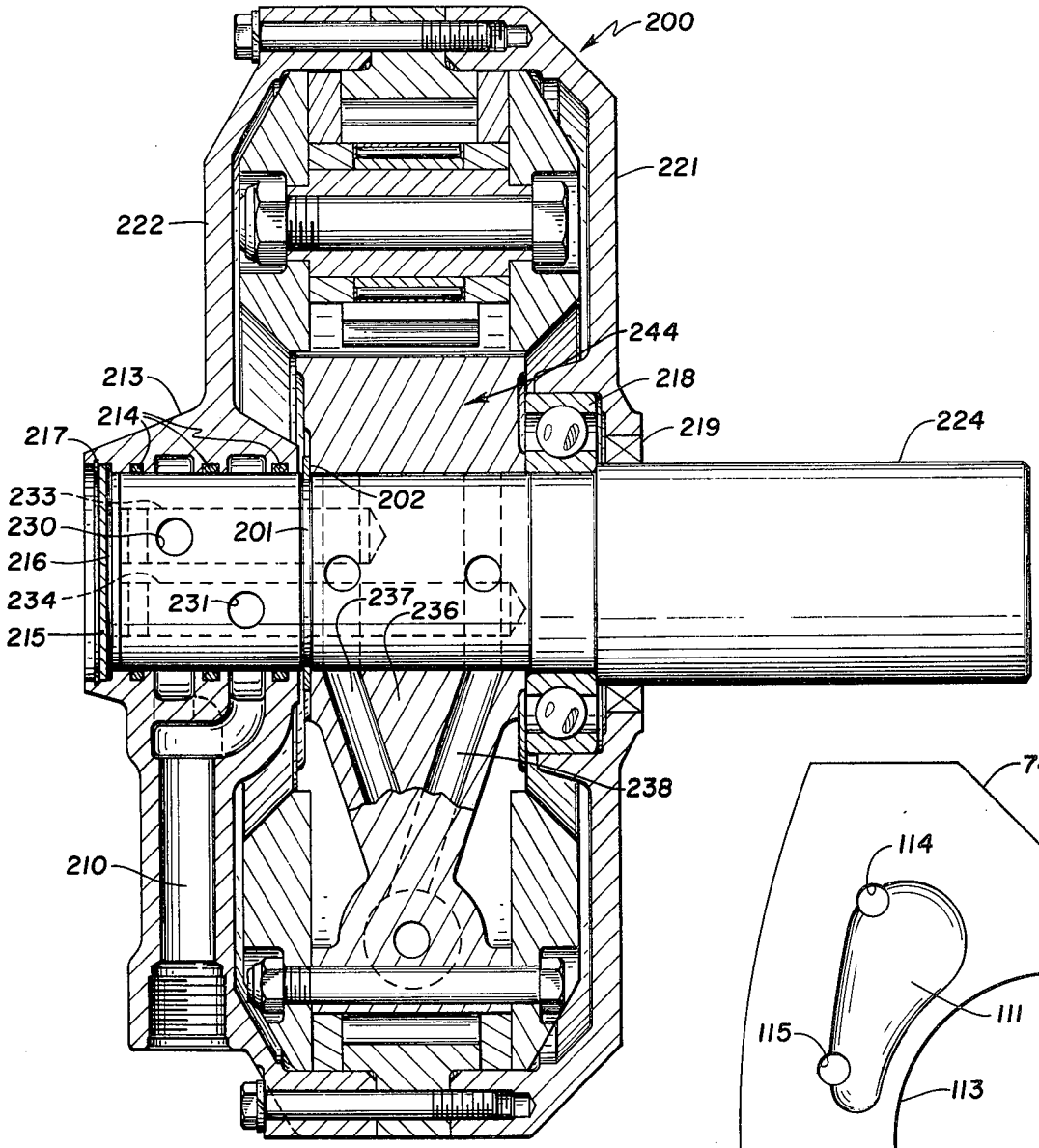
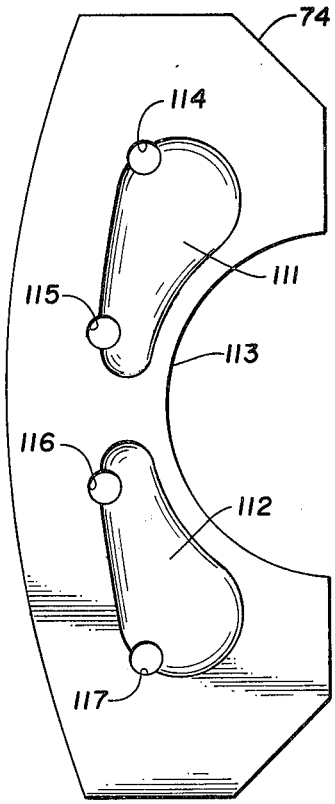
Fig. 7

HYDRAULIC MOTOR OR PUMP WITH MOVABLE WEDGE

This invention relates to the field of fluid motors or pumps and more particularly to a means of improving the pressure or suction chamber within a gear type mechanism.

The invention disclosed herein is directed to the improvement of the gear type pump and motor. The use of an internal ring gear provides a relatively long torque arm of approximately the ring gear's pitch radius as compared to the conventional gear motor's pinion pitch radius. Thus the ring gear also allows the use of multiple pinions to further increase the output torque of the motor. The end result is a very compact motor with all the ruggedness inherent in the conventional gear pump-motor. Through the use of at least two pinions, a balance may be created of outward forces so that torque only is generated on the shaft of the motor and the case bearings serve only to center the ring gear and to support the external loads. It has been found that it is particularly advantageous to use a ring gear which has a number of teeth that is not divisible by the number of pinions and in the particular disclosure herein, the drawings generally show the use of pinion gears having 18 teeth with a diametral pitch of 6. It has been found that a ring gear with 75 teeth in combination with 17 tooth pinions produce a fairly optimum result. Through the use of multiple pinions, the effect of a transmission gear change may be incorporated by directing a given oil supply to a pair of pinions or in the instance of 6 pinions, to the combination of 2, 3, 4, or 6.

While the gearing shown is a 6 diametral pitch (DP) having full depth and a 14½° pressure angle, it may not necessarily be the best selection. However, the pressure angle should be 14½° or less to provide a good width at the tip of the tooth for bearing against slidable wedges which work in combination with the pinion and ring gears. The pressure angle is designed to allow the highest tooth face possible for maximum pressure area and this will be discussed later in changes in the addendum of the mating gears. In other words, through the change of the addendum in the ring and pinion gears, the pressure bearing area of the pinion and mating gear tooth tips may be improved.

The wedges are designed to move into touching relationship with the pinion and ring gears and by proper design of the contours of the wedge, tooth-to-wedge bearing pressures may be maintained within reasonable limits to afford minimum lubricating film thickness and consequent oil loss volume. It is also noted that there is a relationship which exists with respect to the projected pressure area of the wedge which will determine the compensating piston diameter or fluid displacement mechanism which in turn determines the maximum gear width as will be more fully explained later.

It will be well recognized that upon further disclosure of the invention, the fluid motor may have either a stationary shaft or rotating shaft. The same principal may be applied and in fact in some instances, a core unit may be developed for use within the housing and where it is desirable to rotate the driven member in the one direction only, a number of the wedges may be eliminated. It will also be apparent that while the fluid is introduced into the chamber between the gears and side plates through the wedges, there is an additional advantage in accomplishing the delivery of the fluid in this manner by reducing the bulk of the unit if the fluid is introduced, by way of example, from the sides.

It is therefore a general object of this invention to provide a movable wedge member to cooperate with a ring and pinion gear in a fluid motor or pump.

It is another object of this invention to provide in a fluid motor or pump, a movable wedge member in which fluid flows through the tip thereof into a pressure or suction chamber.

It is a further object of this invention to provide a wedge member in a fluid motor or pump having porting in the end thereof to create a hydrostatic pressure in an operable direction to overcome pressure from a pressure chamber.

It is still a further object of this invention to provide compensating side plates to create a lateral pressure against the gears and wedge which is slightly greater than the internal pressure in the wedge.

It is still another object of this invention to provide in a pair of compensating side plates, means forming a fluid displacement mechanism to over balance the fluid pressure in the chamber.

It is still a further object of this invention to provide in a fluid motor or pump, retractable wedges acting in cooperation with a pressure chamber created by a ring and pinion gear.

It is yet another object of this invention to provide in a fluid motor or pump, ring and pinion gears with teeth having greater and smaller addendums respectively working with a movable wedge to provide proper bearing pressure on the tooth tip of the gears.

These and other objects and advantages of the invention will more fully appear from the following description, made in connection with the accompanying drawings, wherein like reference characters refer to the same or similar parts throughout the several views, and in which.

Figure 2A:
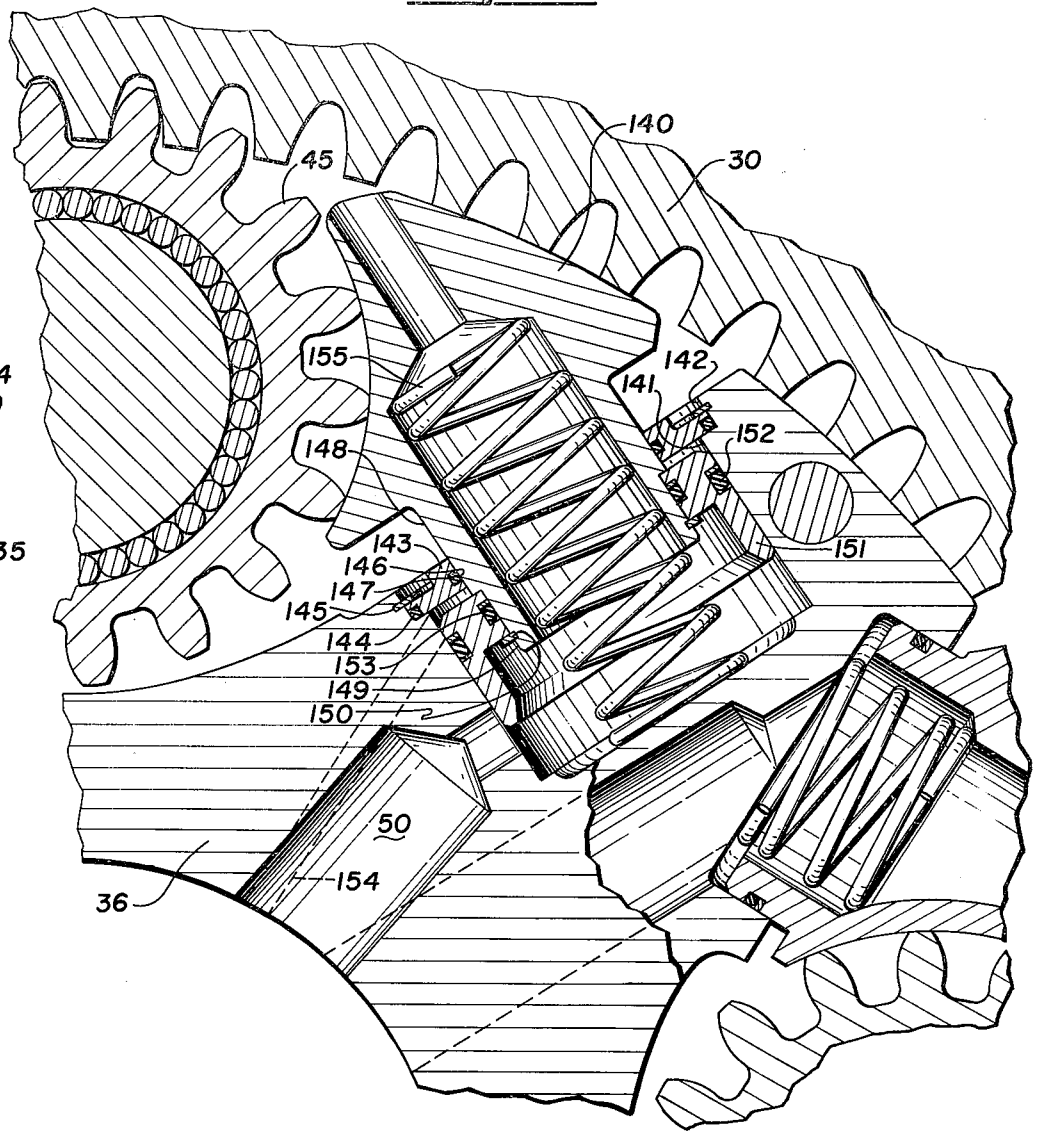
FIG. 2 is a sectional elevation of a core unit disposed in the wheel or sprocket motor in FIG. 1.
Figure 6:
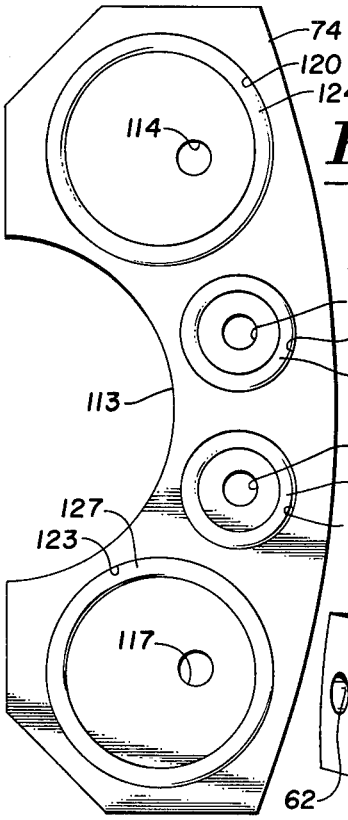
Figure 3:
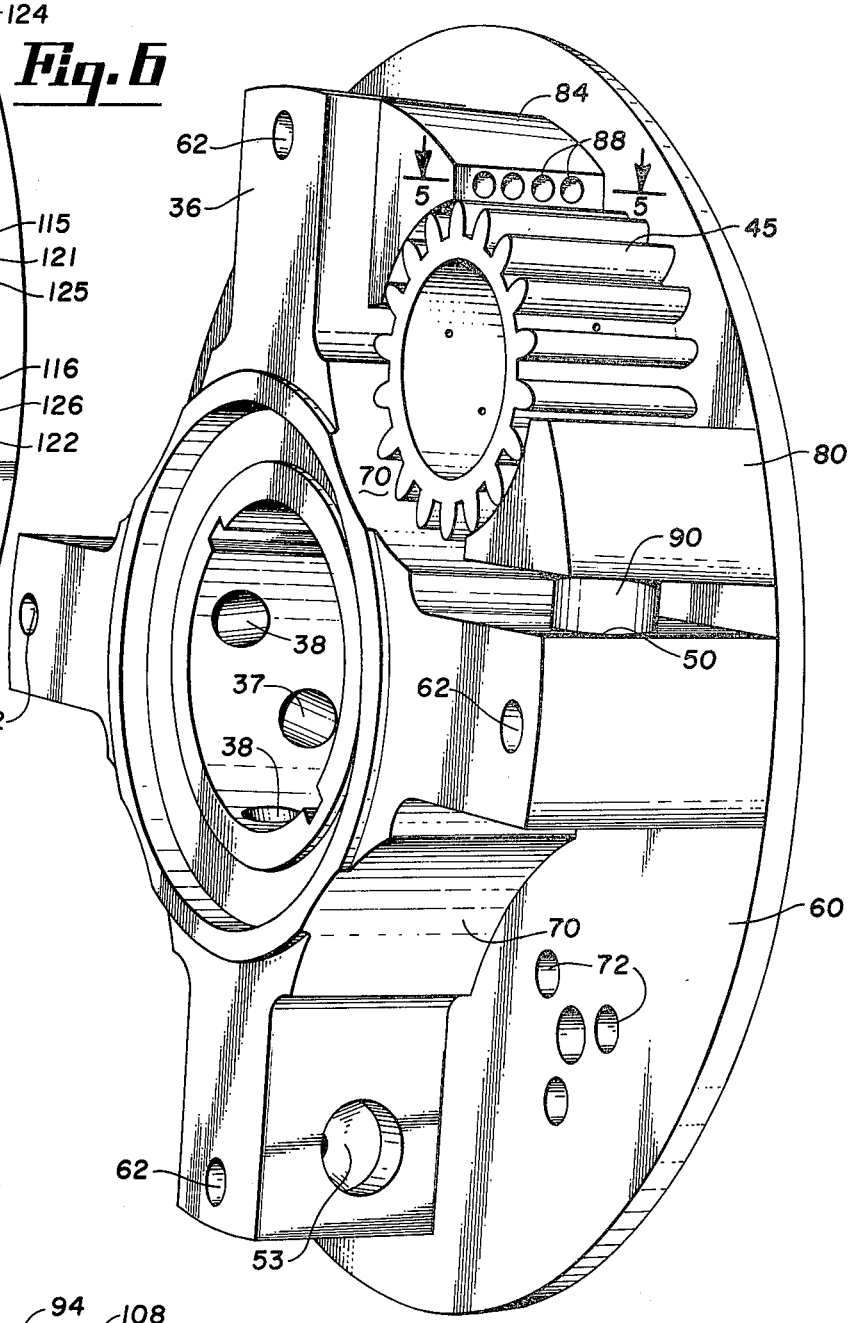
Figure 5:
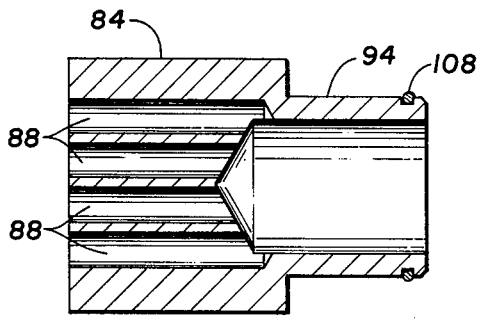
Figure 4:
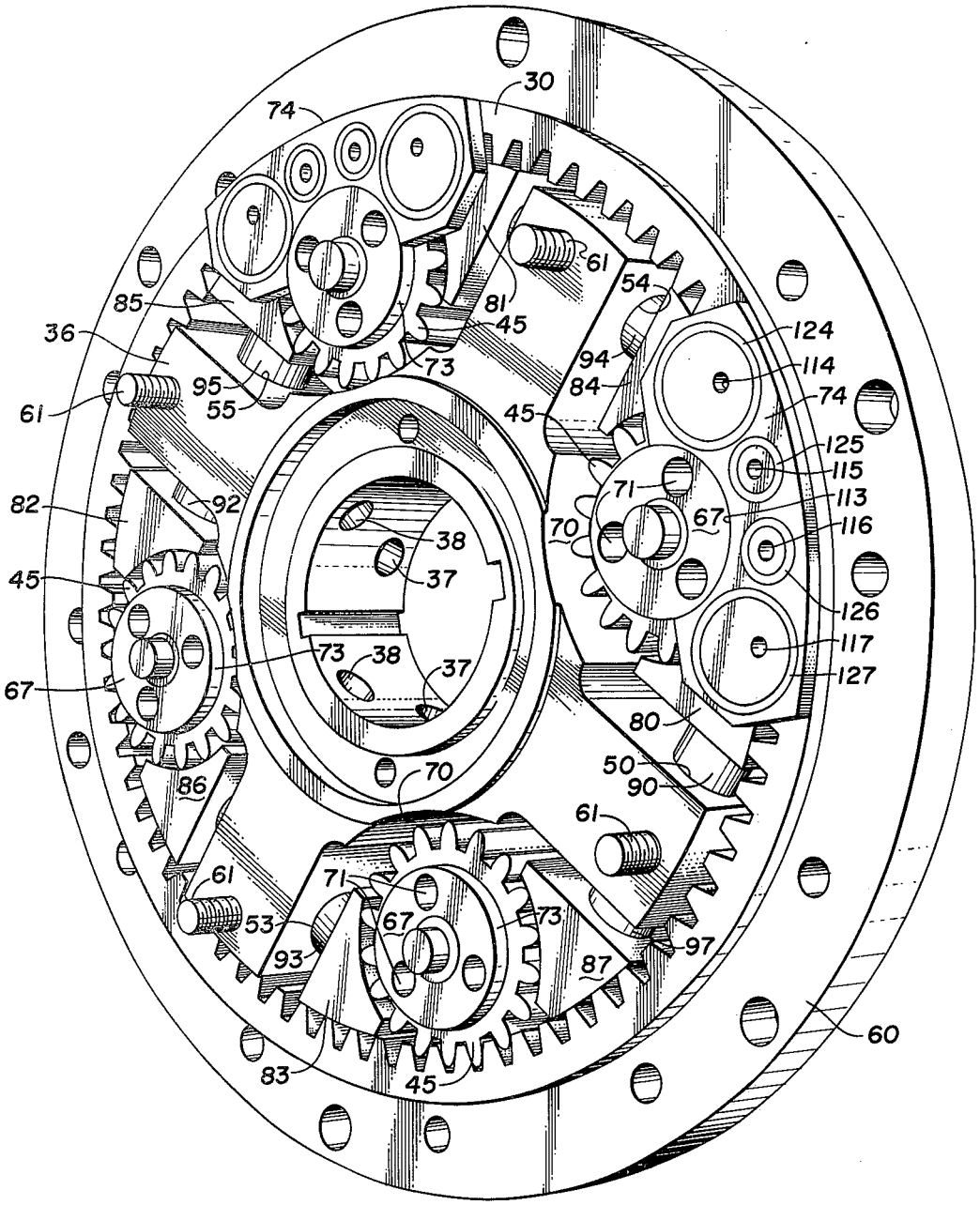
Figure 9:
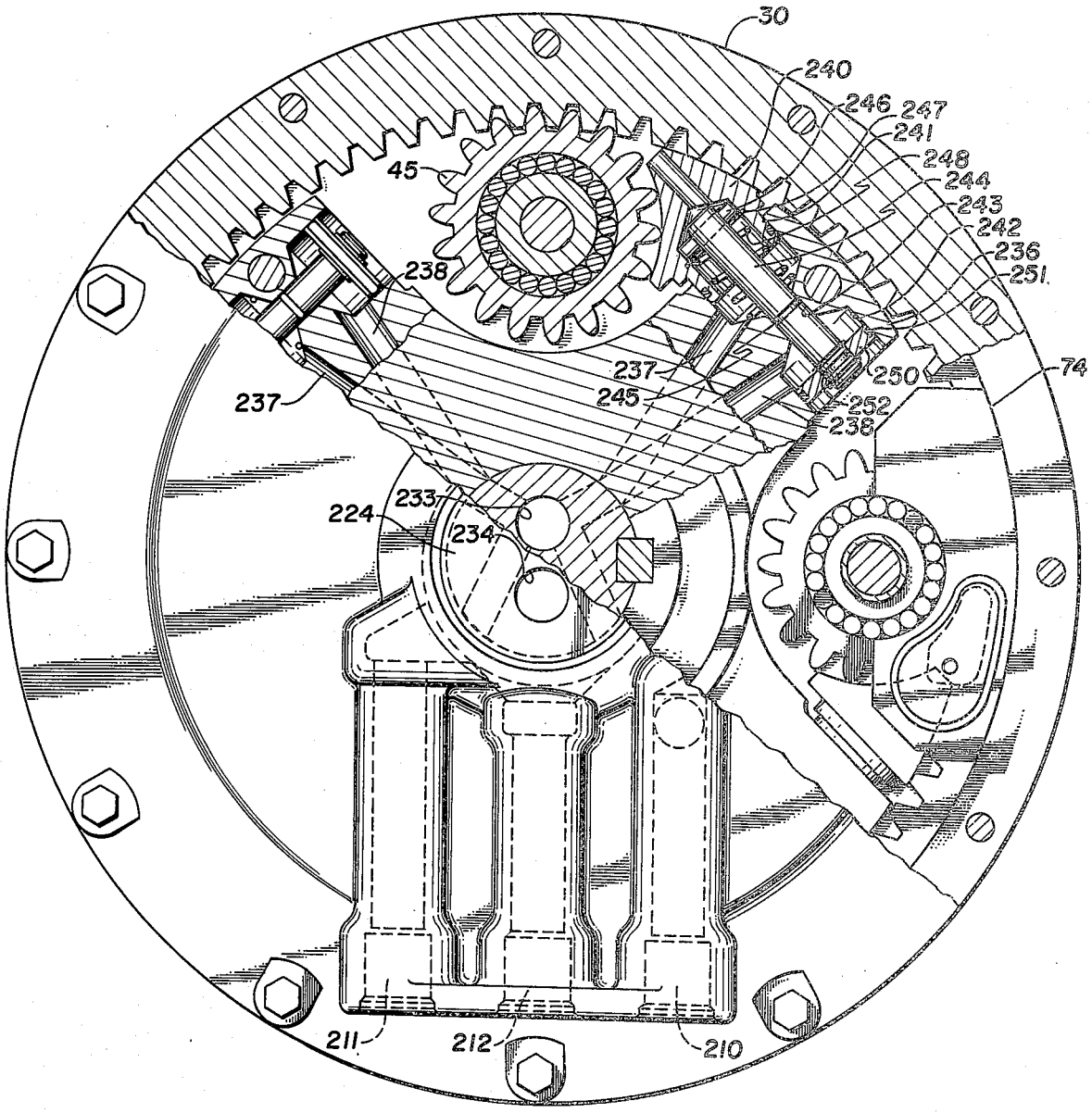

FIG. 2*a* is an enlarged sectional view of an alternate retractable wedge;

FIG. 3 is a perspective view of a subassembly showing a pinion gear in combination with two wedges carried by a spider;

FIG. 4 is a perspective view of a subassembly showing the relative position of the spider, ring gear, pinion gears, wedges, and compensating side plates;

FIG. 5 is a section through a wedge taken along lines 5—5 of FIG. 3;

FIG. 6 shows a piston side of a compensating side plate;

FIG. 7 shows the reverse side of the compensating side plate shown in FIG. 6;

FIG. 8 is a sectional elevation of an alternate version of a fluid motor in which the housing remains stationary and the shaft rotates; and FIG. 9 is a partial section view of the motor mechanism shown generally in FIG. 8.

Figure 1:
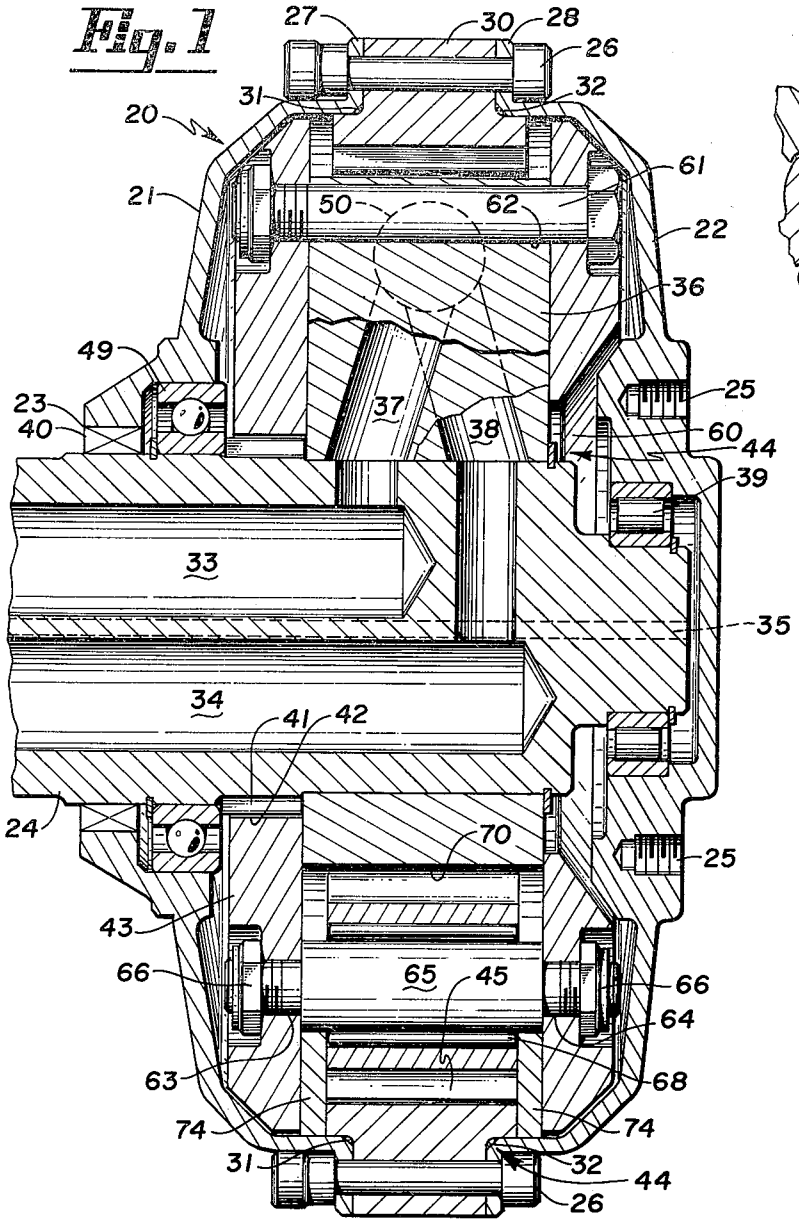
FIG. 1 is a cross-sectional elevation of a wheel or sprocket motor having a fixed shaft.

FIG. 1 shows a two-part housing 20 which includes a first housing or case member 21 and a second housing or case member 22 with an opening 23 formed in housing 21 to accommodate a fixed shaft 24. Housing member 22 includes suitable means such as a tapped portion 25 to which a wheel or sprocket may be secured in suitable manner. A plurality of bolts 26 pass through a plurality of holes formed in a pair of radially extending flanges 27 and 28 of housing members 21 and 22 at the outer periphery thereof to secure the housing or case halves together.

An internal ring gear 30 (FIGS. 1 – 4) is secured in place between the flanges 27 and 28 by bolts 26 and the case or housing is sealed to the ring gear 30 through the use of suitable means such as a pair of compressible seals or O-rings 31 and 32.

Stationary shaft 24 has a pair of axially extending fluid conduit members 33 and 34 formed therein and a case drain port 35 is bored therein (shown in dashed lines) for returning fluids to the source which escape into the housing. Shaft 24 is supported by a pair of ball bearings or anti-friction bearings 49 and 39 respectively adjacent the central opening in housing 21 and at the opposite end of the shaft in the housing member 22. A static oil seal 40 is pressfitted into the central opening 23 in sealing communication with shaft 24. Shaft 24 also includes a pair of splined members 41 engaging a cooperating splined member 42 on a ring plate 43 forming a part of a core member 44. Ring gear 30 is a 75 tooth ring gear which meshes with a plurality of pinion gears 45 which are formed with 18 teeth having a diametral pitch (DP) of 6.

Figure 2:
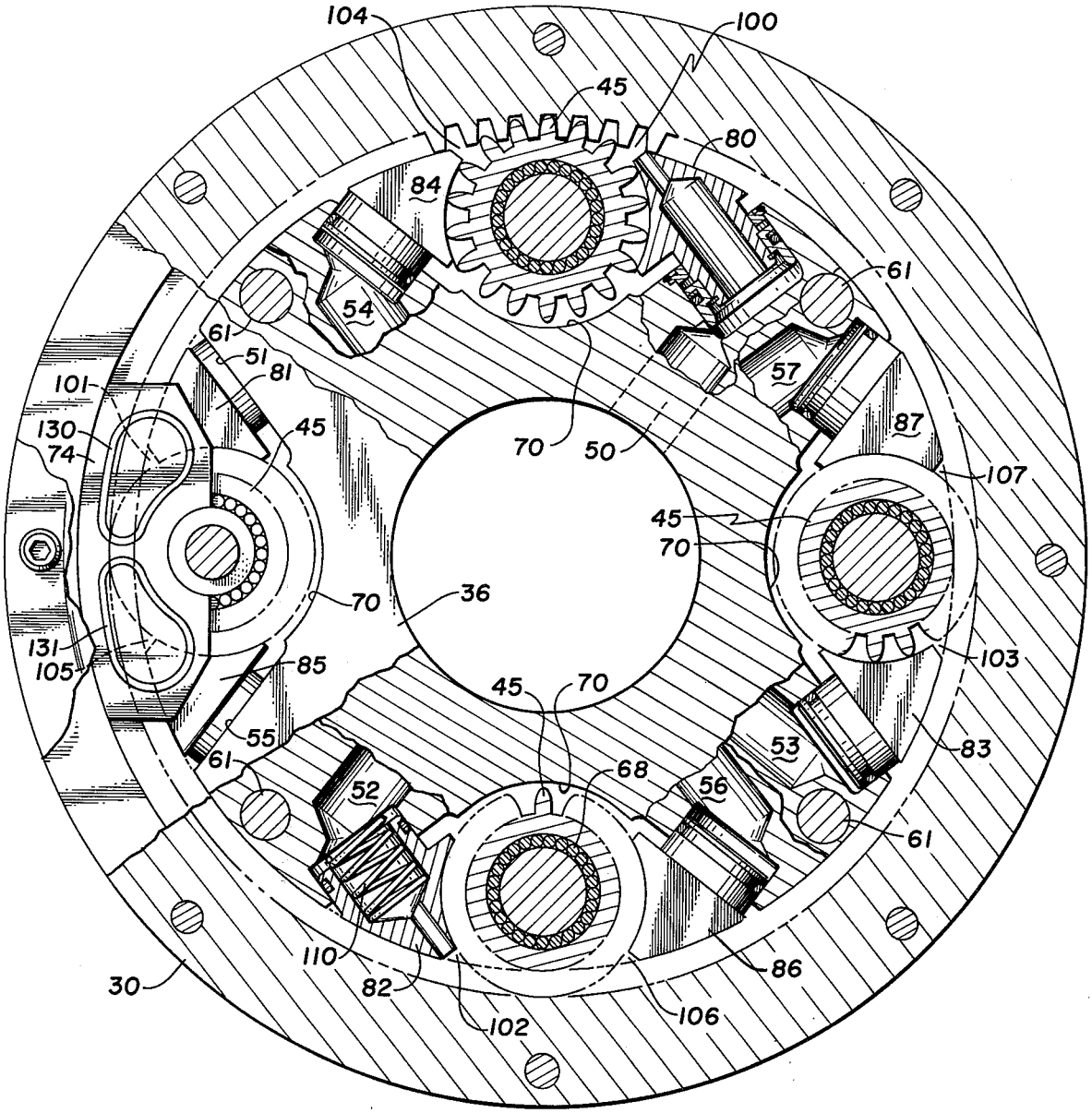

The core unit 44 also includes a spider member 36 which is shown in section in FIG. 2 containing four arms or legs. For optimum results, spider member 36 has a plurality of equal number of radial arms or legs and also includes a pair of fluid passages 37 and 38 which communicate respectively with fluid conduit means 33 and 34 formed in shaft 24. Gear spider 36 has four bores 50, 51, 52, and 53 formed in the outer arms of the spider in transverse manner communicating with fluid passage 37. In like manner, four bores 54, 55, 56 and 57 are formed on the other side of each of the legs of spider 36 and communicate with fluid passage means 38. Spider member 36 is held between ring plate 43 and another ring plate 60 by suitable means such as machine bolts 61 passing through a like plurality of bores 62 formed in spider 36.

Ring plates 43 and 60 have four bores formed therein such as bores 63 and 64 respectively which hold in place, a shouldered post or stub shaft 65 which is threaded on each end to accept a suitable nut 66. In the alternative, FIG. 4 displays post or stub shaft 65 as a bearing member 67 which has a reduced section at the ends thereof to fit into a mating bore formed in ring plates 43 and 60. As shown principally in FIG. 1, the bearing may also be an anti-friction bearing 68 which is secured about post 65 and may be of the needle roller bearing type which is manufactured by the Torrington Manufacturing Company of Torrington, Conn. Spider 36 is relieved to provide a sufficient clearance at its inner radial location 70 adjacent each of pinion gears 45. Where bearing member 67 is used, a plurality of bores 71 are formed transversely in the bearings to provide means for bolting ring plates 60 and 43 through bores 72 in ring plates 60 and 43.

A plurality of compression side plates 74 overlie the sides or edges of the pinion gears 45 and ring gear 30. The compression side plates 74 are shown in more detail in FIGS. 6 and 7 and will be described in greater detail subsequently.

Returning principally to FIG. 4, there is shown therein, eight wedge members, 80 through 87 that cooperate with each of the four pinion gears 45. Each of the wedges have a shape conforming to the outer periphery of ring gear 30 and pinion gears 45. Each of wedges 80 through 87 has a hollow piston end 90 through 97 respectively which communicates internally with porting 88 in the tip thereof to create a means of providing hydrostatic pressure within the hollow piston portions 90 through 97 to overcome pressure created within a pressure or suction chamber formed at the junction of each of wedges 80 through 87, ring gear 30, the four different pinion gears 45, and compression side plates 74. Each of the pressure or suction chambers, designated Nos. 100 through 107 lie within the bounds of the plurality of pressure side plates 74. Each of the hollow piston ends 90 through 97 has an outer annular groove formed therein containing a suitable sealing member such as an O-ring 108 (See FIG. 5). The hydrostatic pressure developed within the hollow piston is sufficient to overcome the pressure from the pressure or suction chambers 100 through 107. It will further be observed that the width of each of wedges 80 through 87 is the same as the width of pinion gears 45 and ring gear 30.

It may also be desirable to add a compression spring 110 within the bore of each of the hollow pistons 90 through 97 to provide a nominal amount of pressure against the wedge to urge it into association with its associated pressure chamber and it has been found that perhaps 10 to 15 pounds of force exerted by the spring is adequate. The spring is only required to be sure that the wedge is in the best position when oil under pressure is fed through the wedge.

Turning now to pressure compensating plates 74, one embodiment of the plates is shown in FIGS. 6 and 7. FIG. 7 shows that side of plate 74 which lies against ring gear 30, pinion gears 45 and a pair of wedges 80 through 87. A pair of relief chambers 111 and 112 are shown in FIG. 7 wherein the relief cavities are somewhat bean shaped and have a fairly thin section removed within the area outlined by the bean shape. The relief areas or cavities 111 and 112 provide an escape for the oil that is entrained tooth to tooth, because there is little or no escape for the hydraulic fluid except through the ends of the tooth space.

It will also be observed that pressure compensating plate 74 has an arcuate section 113 which is of the same radius as that radius on shoulder 73, the portion of bearing 67 extending beyond the side or edge of the pinion gear 45. Thus there is a good supporting surface formed around arcuate section 113 of compensation plate 74.

The other side of compression side plates 74 shows four bores 114, 115, 116, and 117; bores 114 and 115 communicate with cavity 111 and bores 116 and 117 communicate with cavity 112. Encircling each of bores 114 through 117, are four annular grooves 120, 121, 122, and 123 with annular grooves 120 and 123 being substantially larger than the grooves 121 and 122. Secured in each of annular grooves 120 through 123 respectively are four O-rings 124, 125, 126, and 127. That side of compression side plate 74 shown in FIG. 6 is in contact with ring plates 43 and 60 in which the compensation plates 74 are permitted a slight lateral movement. The areas within the annular grooves and sealing rings act much like a piston or fluid displacement mechanism in that the total area within annular grooves 120 through 123 surrounding each of the ports provide a means for furnishing a reacting pressure and whether it be two round areas or some other configuration is not critical. Assuming that the pressure chamber is operating at 1,000 psi, there will also be 1,000 psi within the confines of the limited area of the O-rings and because of the rubber material or sealing and compressing characteristics of the sealing ring, the side plates are forced inwardly against the gearing and wedge bearing surfaces. Because the O-ring confines the oil and is flexible enough to take the amount of relative travel between the pressure compensating side plates 74 and the ring plates, it seals the same so there is no escape of the oil. This thus has the effect of a piston of a given area which is the total area enclosed by the pair of O-rings about the pressure chamber and thus an equal and slightly higher pressure is generated to produce a thin film of bearing oil and provides the bearing against the pinion and gears as they rotate. The area just described must be such that the pressure is slightly greater than the inside pressure area within the wedge and thus the operating pressure would be slightly greater than the 1,000 psi in the pressure chamber.

In some applications, it may be more desirable to have a singular sealing means such as that shown in FIG. 2 in which a pair of bean shaped grooves 130 and 131 are formed which contain a pair of sealing means 132 and 133 respectively. However, the pressure within the bean shape is equal to and slightly greater than the pressure that is on the inside of the piston portion of the wedges. The compensating side plates 74 are all maintained in their relative position by the case portions 21 and 22 at the outer radius, by the arcuate bearing area 113, and the ring plates 43 and 60. In other words, the pressure side plates 74 are allowed to float in position and by simply removing the case covers or sections 21 and 22, the pressure plates can be removed for service or replacement.

Oil enters through a pair of ports 33 or 34 into fluid communication with fluid passages 37 and 38, depending on which direction housing 20 is to be turned. That is, while one set of cooperating wedges 80 through 83 may be functioning to drive the motor, the other wedges 84 through 87 will be functioning as pumps since they are on the suction side of the motor operation and thus permit the return of the oil through the other passage and back to the source. Oil under pressure moves through the wedge which moves into the tooth pressure area of a pressure chamber as far as possible consistent with adequate porting. The reacting pressure against the wedge is opposed by the piston end of the wedge and this pressure is slightly greater to provide adequate oil sealing between the wedge and the gear teeth.

It may also be desirable to make certain changes in the addendum of the ring gear and pinion gears to produce an optimum result for minimum tooth loading. Assuming that a maximum gear tooth tip loading of 500 psi is desirable while permitting a minimum tooth tip loading of zero psi, it has been found that lengthening the normal addendum of the ring gear and shortening the normal addendum on the pinion gears produces a more even distribution of the loading on the gear teeth as the pinion gears rotate. The reason for the longer addendum on ring gear 30 and the shorter addendum on opinion gears 45 is to elongate the gear tooth and permit a narrower width of the tooth tip of ring gear 30 while the pinion gears 45 would have a reduced addendum and thus increase the width of the tooth tip. In other words, the addendum and dedendum height is selected to give an approximate equal tooth tip on both the ring gear and the pinion gears which means that using this combination gives adequate uniform bearing area pressure against the wedge. In other words the pressure area of the pressure chamber which is a function of the width of the pinion, ring gearing, and wedges determines the diameter of the piston portion of the wedge. It may be determined that the pressure area within the confines of the gear teeth of the ring gear and pinion gears varies somewhat as the gear teeth cross the surface of the wedge producing varying pressure areas in the intersection of the gear teeth. Because the pressure areas may vary, the direction of the force on the teeth of the gearing may also vary, but the optimum condition is to keep the pressure line to the piston constant as the lines of force address the wedge moving into the space defined outwardly by the pinion and ring gearing. For this reason, the exact configuration of the porting in the end of the wedge is far less critical than maintaining a constant direction of the force of the fluid within the piston and wedge. That is, the resulting back pressure due to the oil pressure in the pressure chamber produces a resultant which varies somewhat in its direction and this is going to vary the load slightly between the tooth tip and wedge. With the pinion gear turning, it will be found that at times the oil pressure will equal the pressure of the wedge and at other times the oil pressure will change as the teeth of the gear come into a full meshing relationship. By increasing the addendum of the ring gear and shortening the addendum of the pinion gears, an optimum and somewhat constant force created by the hydraulic fluid moving through the wedge is achieved to give optimum results.

Reference is now made to FIG. 2*a* in which there is shown a retractable wedge 140 working in conjunction with one of the pinion gears 45 and ring gear 30. Wedges such as wedge 140 may be used singly with each pinion and ring gear combination where a single direction of the motor is desirable but it is also desirable to produce a neutral position for the motor. In other words, where a spider has four arms, there would be a requirement for only four wedges of the type shown in FIG. 2*a*. Using a pair of wedges with each pinion, would then produce a motor which is not only variable in direction but also controllable as to speed in both directions. It may be assumed that wedge 140 is in communication with the fluid passage 50. A bore 141 is formed in spider 36 which is in communication with fluid passage 50 and is enlarged at the upper end thereof to form a larger bore 142. A collar 143 with a suitable sealing ring 144 is inserted into the outer bore 143 and is held in sealing relationship through the use of an internal retaining ring 145 nested in a cooperating annular groove. An internal annular groove 146 contains an internal sealing ring 147 which bears against a hollow piston portion 148 of wedge 140. The lower end of piston 148 has a smaller diameter section 149 and also contains an outer annular groove in which an outer annular retaining ring 150 is secured.

A sleeve member 151 of inverted U cross-sectional shape has an inner bore of a diameter to accommodate the reduced diameter section 149 of piston 148 and is secured between retaining ring 150 and the shoulder formed between the reduced section diameter and the diameter of piston portion 148. The lower edge of sleeve 151 depends downwardly and extends into the port between fluid passage 50 and the hollow portion of piston 148. An outer annular groove is formed in the outer periphery of sleeve 151 and the two members are sealed with respect to each other through the use of a sealing ring 152. In a similar manner, an internal annular groove is formed in sleeve 151 and a sealing ring 153 forms a seal between piston section 149 and sleeve 151.

A pilot bore 154 acts as a wedge direction control port and is in communication with the annular space between collar 143 and sleeve 151. A compression spring 155 is disposed between the upper end of the bore formed in wedge 140 and the lower portion of the bore 141.

In operation, if it becomes desirable for example, to remove the effect of two opposite pressure chambers and thus direct the given volume of oil to the remaining pressure chambers and thereby effect a speed change, the proper control may be exerted by applying fluid through pilot porting such as 154 where pressure is exerted against sleeve 151 causing it to move downwardly and thus cause wedge 140 to be withdrawn from the pressure chamber between the end of wedge 140 and the gearing. As wedge 140 is moved downwardly, the lower edge of sleeve 151 is observed to close the port from fluid passage 50 and thus wedge 140 is no longer maintaining a pressure chamber and thus provides neither a motoring or pumping function. Pilot port 154 would be extended through shaft 24 in the same manner as the case drain 35 for control thereof. The same reverse movement of wedge 140 may also be used to create an idle condition for the fluid motor. When it becomes desirable to return wedge 140 to its operable position, hydraulic fluid under pressure is removed from pilot port 154 and the slight compression of compression spring 155 causes wedge 140 and sleeve 151 to move towards the pinion and ring gearing and reintroduce pressure into the hollow piston 148 through fluid passage 50.

An alternate version of the invention is shown in FIGS. 8 and 9 in which there is a rotatable shaft 224 and a static housing 200 formed of a first housing section 221 and a second housing section 222. An internal core unit 244 is very similar to that of core unit 44 found in FIG. 1. A spider unit 236 contains a pair of similar fluid passages 237 and 238 which are supplied through a fluid conduit 233 and 234 respectively. Fluid conduits 233 and 234 are fluidly connected through a pair of ports 230 and 231 respectively which are formed in the end of shaft 224 in communication with a pair of inlet ports 210 and 211 respectively. A case drain 212 forms a fluid return for the hydraulic fluid. A hub section 213 forms a bearing around the end of shaft 224 and has three sealing rings 214 seated in annular grooves within the hub section to seal the unit against oil flow around shaft 224. A sealing ring 215 is held in place by a plate 216 which is secured against axial movement by an internal retaining ring 217. The other end of the shaft 224 is supported by an anti-friction or ball bearing 218 and the shaft and case section 221 are sealed against oil leakage through the use of an oil seal 219. Shaft 224 is kept in axial alignment in the bearing through the use of bearing 218 and an outer annular groove 201 containing an outer retaining ring 202.

FIG. 9 discloses another alternate embodiment of a wedge 240 in which a first bore 241 is in full communication with a second bore 242 through a smaller connecting bore 243. A connecting rod 244 has an outer annular groove formed therein in which a sealing ring 245 is disposed, the annular groove and sealing ring being in communication with the smaller bore 243. A pin 246 is passed through a cooperating transverse bore in the upper end of rod 244 and is held in place within the piston end of wedge 240 by an internal retaining ring 247. A compression spring 248 is seated at the bottom of bore 241 and bears against pin 246.

A washer like piston 250 is secured to the other end of connecting rod 244 by suitable means such as retaining rings. Piston 250 has an outer annular groove formed therein in which a sealing ring 251 is secured to form a seal between piston 250 and bore 242. An external annular groove is also formed in connecting rod 244 adjacent piston 250 and another sealing ring 252 is secured therein to form a sealing between connecting rod 244 and piston 250.

In a manner similar to the retractable wedge found in FIG. 2*a*, where it is desirable to control the rotation of a shaft, fluid under pressure may be introduced into fluid passage 237 causing a motoring function. Where it becomes desirable to allow the motor idle, fluid may be introduced into fluid passage 238, thus applying a pressure against piston 250 and cause wedge 240 to move away from the pressure chamber.

It will be recognized that various modifications of the teaching set forth herein may be made in controlling the pressure chamber through the use of a wedge. In other words, the teaching for the use of the rotating shaft is the same principle as that applied to a rotating housing with the exception that provision is made for the entry of the hydraulic fluid and return with a rotating shaft. There is a constant flow of fluid through the ports with sealing rings of the type used with automotive pistons to ensure good oil seals.

It should be remembered that through the use of a long addendum on the ring gear and a short addendum on the pinion gears, it is possible to attain a permissible maximum gear tooth tip loading of for example 500 psi. If it is determined that the maximum gear tooth tip loading is greater than 500 psi, it is then possible to change the sealing limits of the side compression plate 74 or the design of the wedge may be changed slightly as it affects the pressure in the chamber. It may also be desirable to change the diameter of the wedge piston in cooperation with changing the piston area of the side compensation plates. It should also be remembered that optimum results are achieved with a pressure angle equal to 14½° or less which will increase the tooth tip width and also reduce the gear loading. It is also within the realm of the teaching herein that the pinion gear teeth will permit a certain amount of undercut of the root circle to allow a wider internal gear tooth tip loading. It has been found, through the use of lengthening the addendum of the ring gear and shortening the addendum of the pinion gears, the gear width limit may be increased with in increase in torque output of the entire unit.

It will, of course, be understood that various changes may be made in the form, details, arrangement and proportions of the parts without departing from the scope of the invention which consists of the matter shown and described herein and set forth in the appended claims.

What is claimed is:

1. In a fluid motor or pump, the combination comprising:

internal ring gear means operably secured within a housing;

pinion gear means rotatably mounted to mesh with said ring gear means;

wedge means, having a shape conforming to the outer peripheries of said ring and pinion gears to provide a sealing effect and pressure or suction chamber, said wedge means having a piston end and porting in the tip thereof communicating with said chamber forming a hydrostatic pressure means having a hydrostatic pressure in an operable direction to overcome pressure from said chamber;

supporting means within said housing supporting said pinion gear means and supporting said wedge means for slidable movement;

means for delivering fluid under pressure from a source to said pressure chamber; and, means for returning fluid to said source.

2. The structure set forth in claim 1 including:

control means actuating wedge means disposed on the same relative side of their corresponding pinion gear means to move out of communication with said ring and pinion gear means.

3. The structure set forth in claim 1 including:

shaft means journaled in said housing and having said supporting means secured thereto.

4. The structure set forth in claim 3 where said supporting means includes spider means having a plurality of radial arms with fluid pressure passage means extending radially therein with said fluid passage means communicating with said means for delivering fluid under pressure and said means for returning fluid to said source.

5. The structure set forth in claim 1 including:

side plate means overlying the sides of said pinion and ring gear means and said wedge means adjacent each point of intermeshing of said gear means to prevent fluid from escaping from said pressure chambers, said side plate means including pressure compensating means creating lateral pressure against said gear and wedge means in proximity to said pressure chamber, the lateral pressure being greater than the internal pressure in said pressure chamber; and securing means overlying said side plate means and holding the same in limited transverse movement.

6. The structure set forth in claim 5 wherein said pressure compensating means includes:

port means formed transversely in each side plate means in close proximity to said pressure chambers;

groove means formed in said side plate about said port means and disposed opposite the side adjacent said pressure chamber;

and sealing means secured in said groove means working with said side plate means forming a fluid displacement mechanism for over balancing the fluid pressure area in said wedge means and controlling oil film thickness about said gear means in said pressure chamber.

7. A fluid motor or pump comprising:

shaft means;

fluid housing means having an opening in one side thereof and having said shaft journaled in said opening;

fluid conduit means communicating respectively with multiple ports within one of said fluid housing or shaft means;

spider means having a plurality of radial arms with fluid passage means extending radially therein, said spider means being secured to said shaft means within said housing means with said fluid passage means communicating with said fluid conduit means;

internal ring gear means secured in said housing means;

pinion gear means carried by said spider means and mounted to mesh with said ring gear means;

a pressure chamber;

wedge means carried by said spider means and being slidably movable into touching relationship with, and between, the teeth of said pinion and ring gear means defining a pressure or suction chamber on all but two sides, said wedge means having a piston end and at least one port in the tip thereof communicating with said chamber forming a hydrostatic pressure means having a hydrostatic pressure in an operable direction to overcome pressure from the chamber, said piston end being in fluid communication with said fluid passage means in said spider means;

side plate means overlying the sides of said pinion and ring gear means and said wedge means to create a plurality of said pressure chambers adjacent each point of intermeshing of said gear means and prevent fluid from escaping from said pressure chambers, said side plate means including pressure compensating means creating lateral pressure against said gear and wedge means in proximity to said pressure chamber, the lateral pressure being greater than the internal pressure in said wedge means; and, ring plate means overlying said spider means and said side plate means and secured against lateral movement.

8. The structure set forth in claim 7 wherein said pressure compensating means includes:

port means formed transversely in each side plate means in close proximity to said pressure chambers;

groove means formed in said side plate about said port means to define a predetermined area therewithin and disposed opposite the side adjacent said pressure chamber;

and sealing means secured in said groove means working with said ring plate means forming a fluid displacement mechanism for over balancing the fluid pressure area in said wedge means and controlling oil film thickness about said gear means in said pressure chamber.

9. The structure set forth in claim 7 wherein said ring and pinion gear means respectively include teeth on a ring gear having an addendum and tooth tip width which is respectively greater and smaller than the teeth on each pinion gear mating therewith.

10. The structure set forth in claim 7 wherein each of said wedge means having a general shape conforming to the outer peripheries of said ring and pinion gear means permitting it to be extended into the void between said ring and pinion gear means and having a hollow cylindrical body extending therefrom slidably communicating with said fluid passage means in said spider means.

11. The structure set forth in claim 7 including: compression spring means secured within each of said wedge means uring said wedge means into close relationship with said ring and pinion gear means.

12. The structure as set forth in claim 7 wherein the number of teeth in said internal ring gear means is indivisible by the number of said pinion gear means.

13. The structure as set forth in claim 7 wherein the teeth of said ring and pinion gear means includes a pressure angle of no greater than fourteen and one-half degrees.

14. The structure as set forth in claim 7 including: bearing means having a hub extending laterally beyond the teeth of said pinion gear means;

each of said plate means having a mating circular section communicating with said hub, said side plate means also being confined by said fluid housing and said ring plate means against radial and lateral movement.

15. A fluid motor for transmitting power comprising:

a shaft fixedly supported having a pair of axially extending fluid conduit means, each communicating respectively with a pair of ports;

a fluid housing having an opening in one side thereof and being rotatably supported by said shaft through said opening;

a spider having a plurality of equal number radial arms with fluid passage means extending radially therein, said spider being secured to said shaft within said housing with said fluid passage means communicating with said fluid conduit means;

an internal ring gear secured to said housing;

a plurality of pinion gears carried by said spider and mounted to mesh with said ring gear;

a plurality of presure or suction chambers;

a plurality of wedges carried by said spider movable into touching relationship with, and between, the teeth of said pinion and ring gears defining said pressure or suction chambers on all but two sides, said wedges having a piston end and at least one port in the tip thereof communicating with said chambers forming a hydrostatic pressure means having a hydrostatic pressure in an operable direction to overcome pressure from said chambers, said piston end being in fluid communication with said fluid passage means in said spider;

a plurality of compression side plates overlying the sides of said pinion and ring gears and said wedges to create a plurality of pressure chambers adjacent each point of intermeshing of said gears, said side plates including pressure compensating means creating lateral pressure against said ring gear, pinion gears, and wedge in proximity to said pressure chamber, the lateral pressure being greater than the internal pressure in said wedge; and, a pair of ring plates overlying said gear spider and said plurality of compression side plates and secured with respect to each other against outward transverse movement.

16. The structure set forth in claim 15 wherein said pressure compensating means includes:

at least one port formed transversely in each side plate adjacent each of said pressure chambers;

at least one groove formed in said side plate about all of said ports related to each pressure chamber, and disposed on the side opposite said pressure chamber;

and sealing ring means secured in all of said grooves working with said ring plates forming a fluid displacement mechanism for over balancing the fluid pressure area in said wedge.

17. The structure set forth in claim 15 including:

pressure relief means formed in each of said plurality of side plates having relief cavities adjacent said pressure chambers and circumferentially along the edge of said pinion gears.

18. The structure set forth in claim 15 including:

a compression spring secured within each of said wedges urging said wedge into close relationship with said ring and pinion gears.

19. The structure set forth in claim 15 including:

control means actuating wedges disposed on the same relative side of their corresponding pinion gears to move out of communication with said ring and pinion gears.

20. The structure as set forth in claim 15 including: a plurality of bearings each of which has a hub extending laterally beyond the teeth of said pinion gears;

each of said compression side plates having a mating circular section communicating with said hub, said side plates being confined radially by said fluid housing and laterally by said ring plates.

21. The structure as set forth in claim 15 including:

at least one bore operably disposed in said spider and slidably carrying one of said plurality of wedges therein;

at least one additional bore operably disposed opposite said first mentioned bore;

a connecting passage in between said first and second mentioned bores;

a first fluid control passage communicating with said first mentioned bore;

a second fluid control passage communicating with said last mentioned bore;

a piston member operably disposed within said last mentioned bore; and, a connecting member operating in sealing relationship with said connecting passage and securing said wedge to said piston member through said connecting passage, said connecting member controlling the piston of said wedge in accordance with the pressures in said first and second fluid control passages.

* * * * *